US006854777B2

(12) United States Patent
Jung

(10) Patent No.: US 6,854,777 B2
(45) Date of Patent: Feb. 15, 2005

(54) MAGNETIC LIFTING MACHINE USING NEODYMIUM MAGNETS

(76) Inventor: Hyung Jung, 122-904 Byucksan APT, Gaya-2-dong, Pusanjin-gu, Pusan 614-012 (KR)

( * ) Notice: Subject to any disclaimer, the term of this patent is extended or adjusted under 35 U.S.C. 154(b) by 161 days.

(21) Appl. No.: 10/354,910

(22) Filed: Jan. 30, 2003

(65) Prior Publication Data

US 2003/0146633 A1 Aug. 7, 2003

(30) Foreign Application Priority Data

Feb. 1, 2002 (KR) ..... 10-2002-0005859

(51) Int. Cl.[7] ..... B66C 1/04; H01F 7/04
(52) U.S. Cl. ..... 294/65.5; 335/288; 335/295
(58) Field of Search ..... 294/65.5; 335/285, 335/288, 295–298, 302–306; 269/8

(56) References Cited

U.S. PATENT DOCUMENTS 5,266,914 A * 11/1993 Dickson et al. ..... 335/288
5,435,613 A * 7/1995 Jung ..... 294/65.5
6,331,810 B1 * 12/2001 Jung ..... 335/288

* cited by examiner

*Primary Examiner*—Dean J. Kramer
(74) *Attorney, Agent, or Firm*—Porter Wright Morris & Arthur LLP

(57) ABSTRACT

A magnetic lifting machine according to the present invention is to prevent an antioxidant film on the surface of neodymium magnets from exfoliation, by having the neodymium magnets not be in direct contact with a pair of polarity plates of the machine but via anti-exfoliation plates made of non-magnetic material. The anti-exfoliation plates are fitted to both sides of a rotor containing the neodymium magnets therein between the polarity plates, and each of the anti-exfoliation plates may include a plurality of holes for oil storage radially therethrough.

2 Claims, 12 Drawing Sheets

(a)

(b)

(a)

(b)

MAGNETIC LIFTING MACHINE USING NEODYMIUM MAGNETS

FIELD OF THE INVENTION

The present invention relates to a magnetic lifting machine using neodymium magnets, and more particularly to a magnetic lifting machine using neodymium magnets, which prevents an antioxidant film on the surface of a neodymium magnet from exfoliation, thereby improving magnetic performance and durability thereof.

BACKGROUND OF THE INVENTION

Conventionally, a magnetic lifting machine as disclosed in Japanese Utility Model Publication No. 1994-55206 comprises a pair of pole plates disposed to be opposite each other on both side ends of the machine and having a non-magnetic medium in the longitudinal center thereof and magnetic members on both sides of the non-magnetic medium; a cylindrical rotor axially supported to be rotatable between the pole plates; a pair of rotational permanent magnets inserted in the rotor and having its magnetic poles opposite to each other; and a pair of fixed permanent magnets disposed on both sides of the rotor. In such a conventional magnetic lifting machine, by rotating the rotor, directions of lines of magnetic force of the rotational permanent magnets with respect to the magnetic members could be changed.

This construction allows the magnetic lifting machine to lift and release ferromagnetic objects depending on on/off position of a switch handle.

For the rotational permanent magnet of the conventional magnetic lifting machine, a ferrite magnet having magnetic flux density under 2,000 gauss was widely used. In order to improve magnetic attractive performance of the lifting machine, however, a relatively large size of the ferrite magnet was required. The large size of the ferrite magnetic necessitated a relatively large size of the magnetic lifting body in the magnetic lifting machine, which was disadvantageous to use and in view of high manufacturing costs as well.

In order to overcome these disadvantages, use of a neodymium magnet having magnetic flux density in the range of 10,000–13,000 gauss has been suggested. However, the neodymium magnet has a fatal disadvantage in that it is easily oxidized when exposed to atmosphere, thereby lowering magnetization.

In order to prevent the above disadvantage, coating on the surface of the neodymium magnet with resin or metal may be suggested. However, use of the coated neodymium magnet in the rotor results in exfoliation of the coated film on the magnet because the neodymium magnet rotates in contact with the pole plates and becomes worn by the friction.

Therefore, in order to solve the above problem, the inventor of the present invention suggested an improved magnetic lifting machine by using the neodymium magnet with excellent coercive force in Korean Patent Publication No. 2002-104765, in which an airtight part kept in vacuum or filled with antioxidant materials is provided in the vicinity of the neodymium magnet to prevent the neodymium magnet from being exposed to or contacted with the air.

This magnetic lifting machine can prevent the oxidation of the neodymium magnet, and thus performance and durability of the machine can be improved. Also, by using the neodymium magnet, the overall volume of the machine can be reduced, enabling users to carry and handle the machine easily.

However, this magnetic lifting machine has disadvantages in that many parts or accessories are required to form the airtight part, thereby increasing manufacturing costs, and the machine becomes complicated.

SUMMARY OF THE INVENTION

The object of the present invention is to provide a magnetic lifting machine which uses neodymium magnets having excellent coercive force but prevents an antioxidant film on the surface of the neodymium magnets from being exfoliated.

Another object of the present invention is to provide a magnetic lifting machine whereby change of directional positions of a rotor for switching on and off magnetization can be done smoothly, thus enhancing the credibility and commercial applicability thereof.

Another object of the present invention is to provide a magnetic lifting machine which can be manufactured with lower costs and with smaller volume than conventional magnetic lifting machines.

In order to achieve the above objects, a magnetic lifting machine according to the present invention generally comprises a pair of polarity plates disposed to be opposite each other to form side walls of the machine and having a non-magnetic medium in the longitudinal center thereof and magnetic members on both sides of the non-magnetic medium; a cylindrical rotor axially supported to be rotatable between the polarity plates; a pair of neodymium magnets inserted in the rotor and having its N/S magnetic poles opposite to each other; a spacer plate disposed below the rotor between the polarity plates; a pair of fixed magnets placed on both ends of the spacer plate to be in the vicinity of the rotor; a top cover having a hook; side walls to form the other side walls of the machine; and a shaft having a switch handle thereon, and is characterized in that it further comprises thin anti-exfoliation plates made of non-magnetic material and fitted to both sides of the rotor to prevent the neodymium magnets coated with antioxidant film from being exfoliated.

In the magnetic lifting machine of the present invention, by the rotation of the rotor, directions of lines of magnetic force of the neodymium magnets with respect to the magnetic members are changed.

According to the present invention, since the neodymium magnets inserted in the rotor is in contact with the polarity plates via thin anti-exfoliation plates attached thereon, the coated film of the neodymium magnets can be effectively protected from exfoliation caused by the friction which occurs in the course of rotation.

In addition, the magnetic lifting machine of the present invention further comprises a plurality of holes radially formed on the anti-exfoliation plates for oil storage therein.

Lubricants such as grease can be supplied to and stored in the plurality of holes to reduce the friction and to allow the rotor to rotate smoothly. By forming these holes on the anti-exfoliation plate, change of operational directions of the rotor to switch on and off the machine can be smoothly achieved, and thus credibility and commercial applicability of the machine can be improved.

BRIEF DESCRIPTION OF THE DRAWINGS

The accompanying drawings, which are included to provide a further understanding of the invention and are incorporated in and constitute a part of this specification, illustrate an embodiment of the invention and together with the description serve to explain the principles of the invention, wherein:

FIG. 5(*b*) is a cross-sectional view along the line C—C in FIG. 5(*a*).

FIG. 7(*b*) is a cross-sectional view along the line D—D in FIG. 7(*a*).

FIG. 9(*b*) is a sectional view along the line E—E in FIG. 9(*a*).

FIG. 11(*b*) is a sectional view along the line F—F in FIG. 11(*a*).

DETAILED DESCRIPTION OF THE PREFERRED EMBODIMENTS

Figure 1:
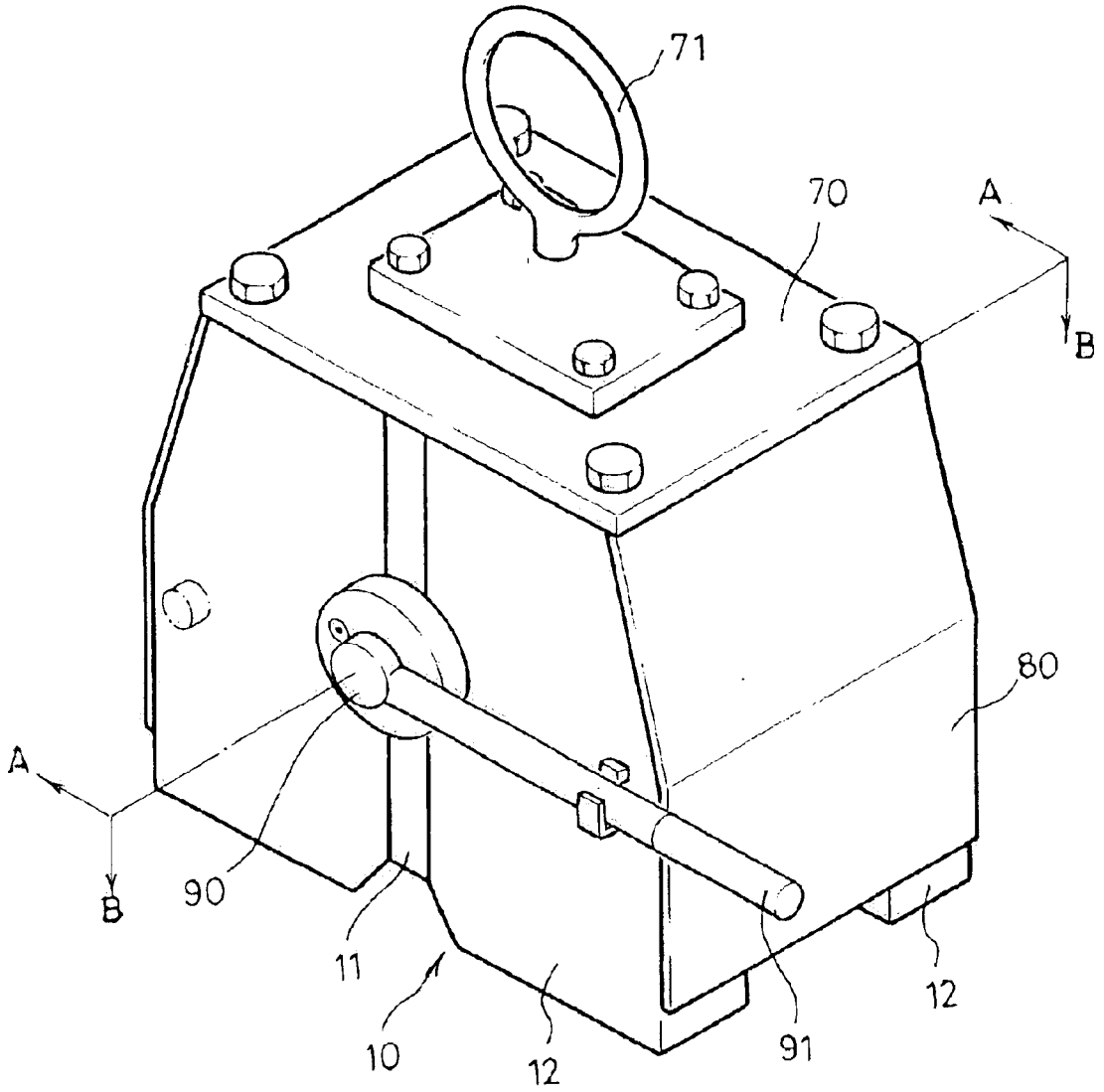
FIG. 1 is a perspective view of a magnetic lifting machine according to the present invention.
Figure 2:
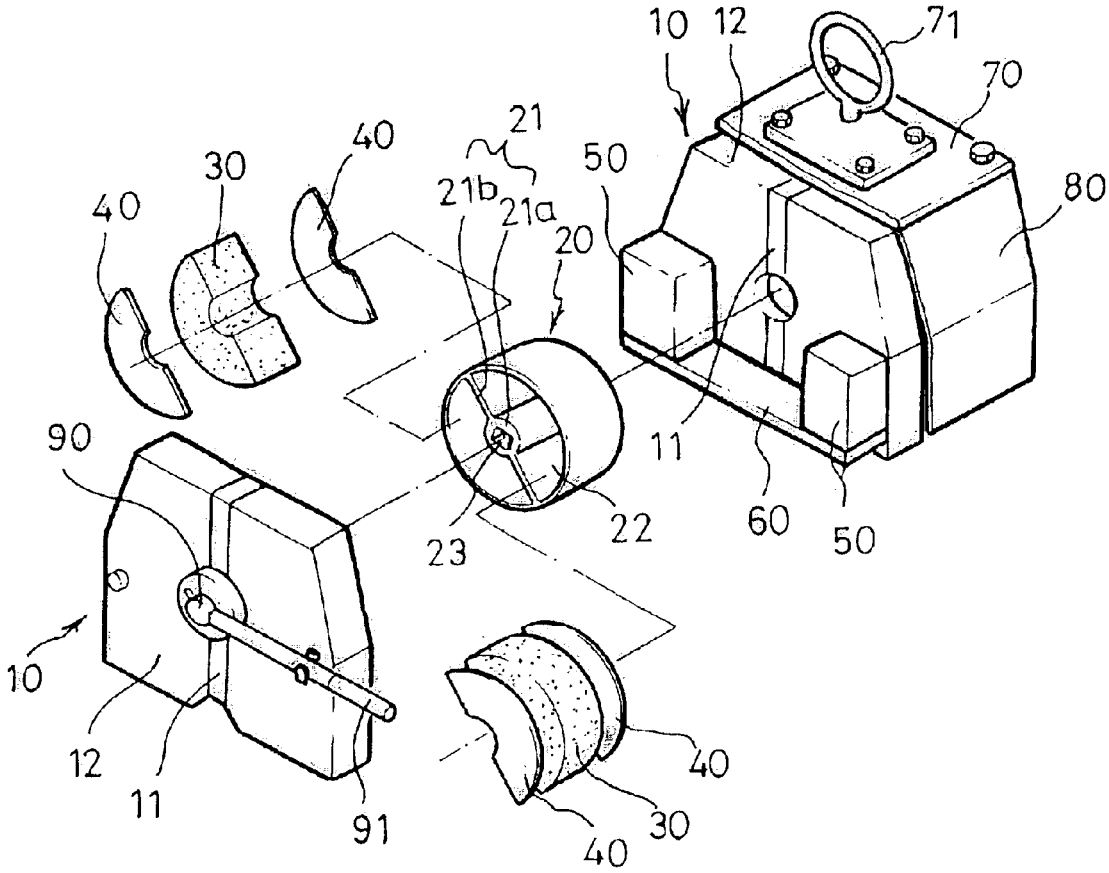
FIG. 2 is a disassembled perspective view of the magnetic lifting machine according to the present invention.
Figure 3:
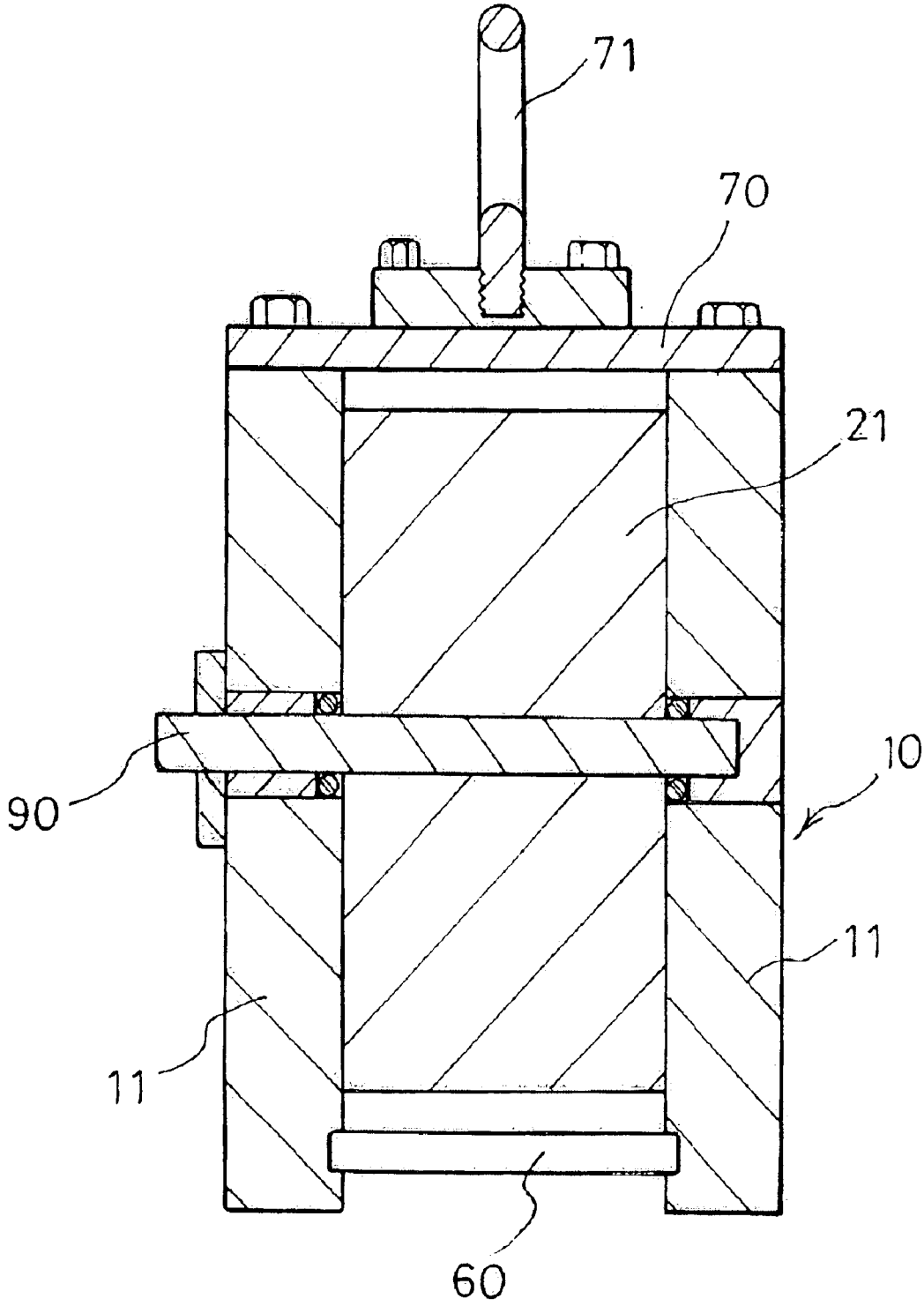
FIG. 3 is a sectional view along the line A—A in FIG. 1.
Figure 4:
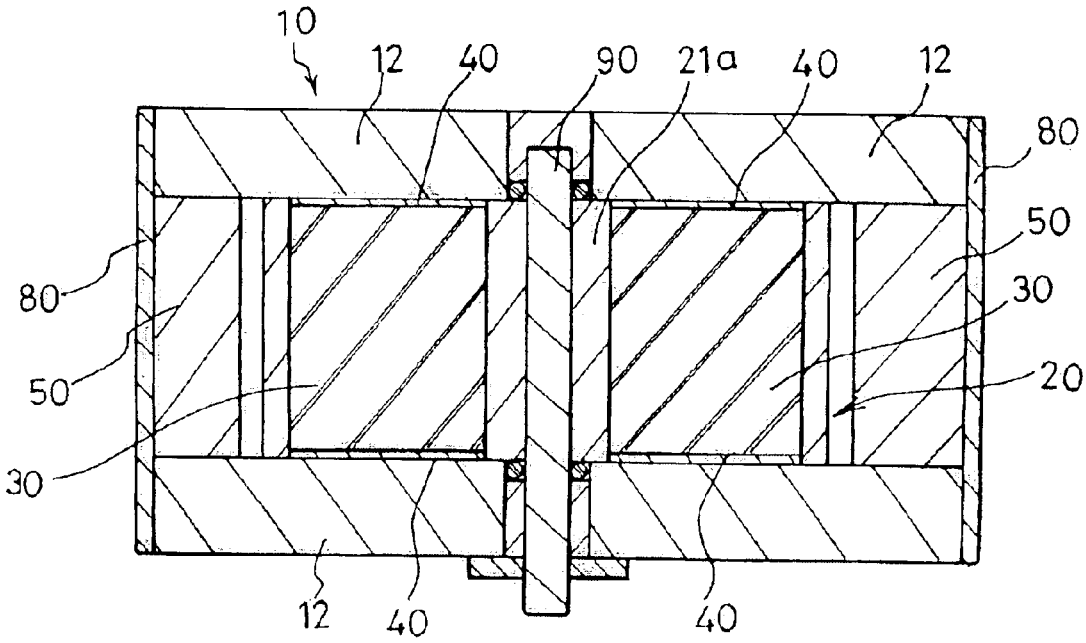
FIG. 4 is a cross-sectional view along the line B—B in FIG. 1.

Reference will now be made in detail to preferred embodiments of the present invention in conjunction with the accompanying drawings.

A magnetic lifting machine is generally used to lift, convey and release iron objects by magnetizing on and off with a switch handle, i.e., by changing directions of lines of magnetic force.

Referring to FIGS. 1 to 5, a first embodiment of the magnetic lifting machine according to the present invention will be described hereinafter.

The magnetic lifting machine according to the present invention comprises a pair of polarity plates (10) disposed to be opposite each other to form side walls of the machine and having a non-magnetic medium (11) in the longitudinal center thereof and magnetic members (12) on both sides of the non-magnetic medium (11); a cylindrical rotor (20) axially supported to be rotatable between the polarity plates (10); a pair of neodymium magnets (30) inserted in the rotor (20) and having its N/S magnetic poles opposite to each other; a spacer plate (60) disposed below the rotor (20) between the polarity plates (10); a pair of fixed magnets (50) placed on both ends of the spacer plate (60) to be in the vicinity of the rotor (20); a top cover (70) having a hook (71); side walls (80) to form the other side walls of the machine; and a shaft (90) having a switch handle (91) thereon, and it further comprises thin anti-exfoliation plates (40) made of non-magnetic material and fitted to both sides of the rotor (20) to prevent the neodymium magnets (30) coated with antioxidant film from being exfoliated.

If the switch handle (91) formed on one end of the shaft (90) is rotated, directions of magnetic forces of the neodymium magnets (30) inserted in the rotor (20) are changed, and the polarity of the line of magnetic force is changed. Then, the polarity plates (10) are switched on, and thus the lifting machine can adsorb and lift objects and the objects can be conveyed to other places using a hoist, etc.

The most important factor in the present invention is that the magnetic lifting machine is provided with the anti-exfoliation plates (40) to prevent exfoliation of the coated antioxidant film on the neodymium magnets (30). As most of the other structure of the magnetic lifting machine is substantially the same as that of the conventional lifting machine disclosed in Korean Patent Publication No. 2002-104765, the rotor (20) having the anti-exfoliation plates (40) fitted thereto will be hereinafter described in detail.

The rotor (20) is made of non-magnetic synthetic resin and formed in the shape of a cylinder. The rotor (20) has a central support (21) which divides the cylindrical rotor into two parts along the diameter. The central support (21) includes a boss (21*a*) in the center thereof and arms (21*b*) along the diameter, and in the boss (21*a*), a rectangular axis aperture (23) is formed, through which the shaft (90) passes. The two parts formed on the left and the right of the central support (21) function as receptacles (22) to accommodate therein a pair of the neodymium magnets (30) having its S/N poles in opposite to each other.

The neodymium magnet (30) is in the form of a semicircle, which is substantially the same as the cross-section of the receptacle (22), but the thickness of the neodymium magnets is slightly less than that of the periphery of the rotor (20). Thus, when the neodymium magnets (30) are inserted in the receptacles (22) of the rotor (20), stepping portions (24) are formed to have the anti-exfoliation plates (40) fitted thereto, as shown in FIG. 5*b*. The neodymium magnets (30) are coated with antioxidant film.

The anti-exfoliation plates (40) are made of stainless or brass plates with the thickness of 0.2~0.3 mm, and in the form of a semicircle, which is substantially the same as the cross-section of the receptacles (22).

Figure 5:
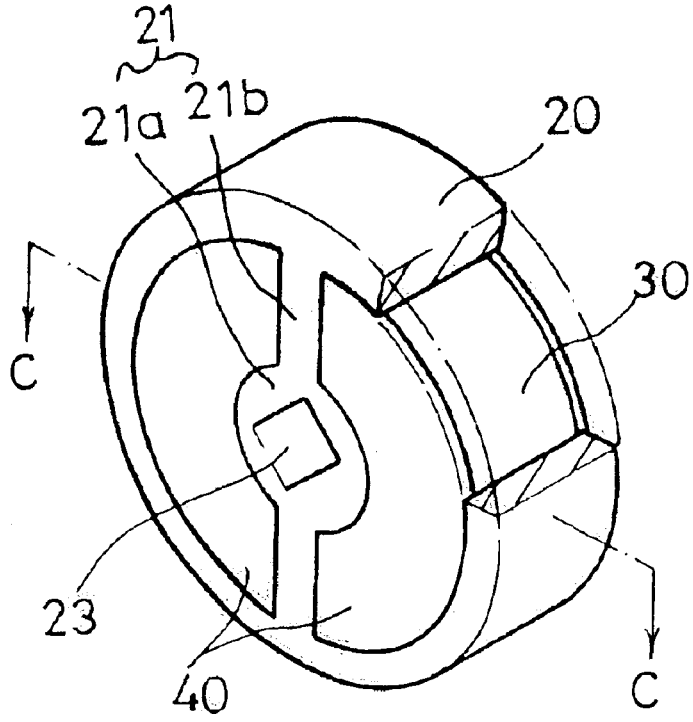
FIG. 5(*a*) is a perspective view partially in section showing a rotor, neodymium magnets and anti-exfoliation plates.
Figure 5:
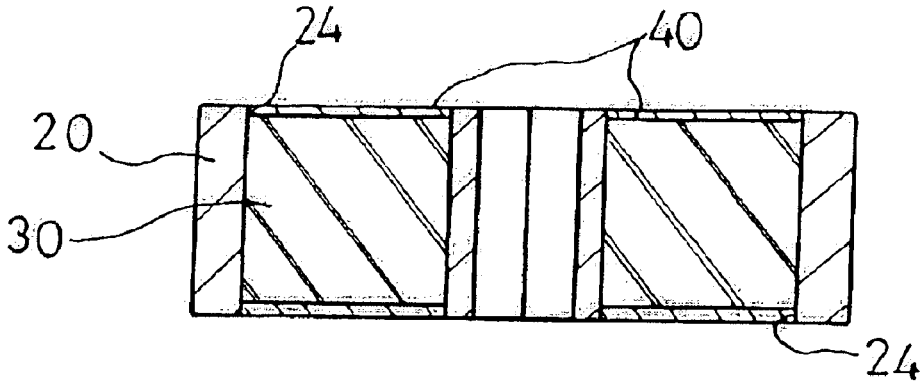

As shown in FIG. 5, the rotor (20), the neodymium magnets (30) and the anti-exfoliation plates (40) are combined together by inserting a pair of the neodymium magnets (30) into the receptacles (22) of the rotor (20) respectively, and then by fitting the four anti-exfoliation plates (40) into the four stepping portions (24) which are formed on both sides of each of the magnets (30) due to the difference in thickness of the rotor (20) and the neodymium magnets (30).

The rotor (20) combined with the neodymium magnets (30) and the antiexfoliation plates (40) as in the above is disposed between the polarity plates (10) and is axially supported to be rotatable by the shaft (90).

According to the first embodiment of the magnetic lifting machine constructed as in the above, since the neodymium magnets (30) are in contact with the polarity plates (10) via the thin anti-exfoliation plates (20), the antioxidant film of the neodymium magnets (30) can be protected from the friction which occurs in the course of rotation.

Figure 6:
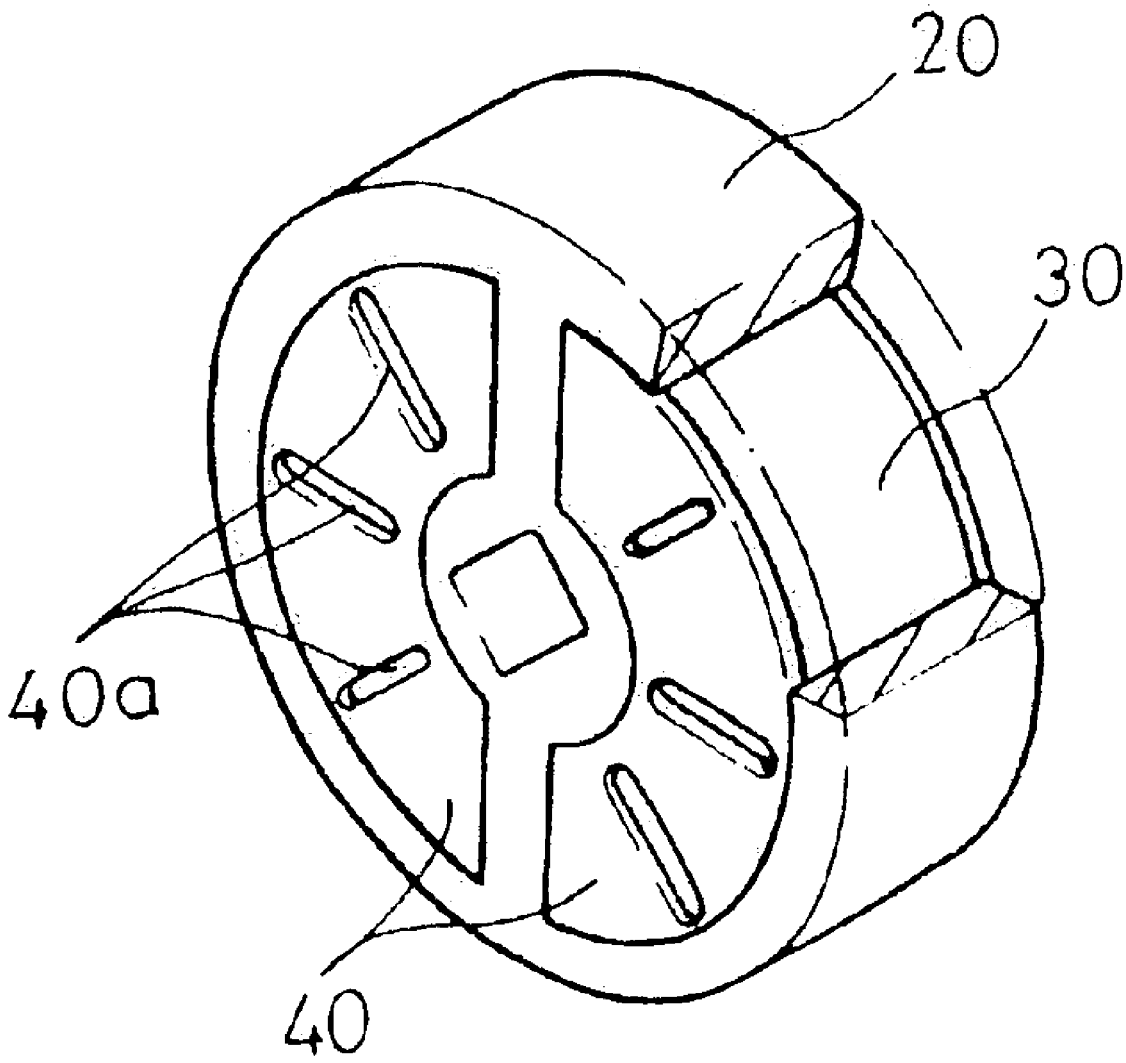
FIG. 6 is a perspective view partially in section showing a modification of the exfoliation plates in FIG. 5.

In the first embodiment, the anti-exfoliation plates (40) are shaped in the form of thin plates. However, in the modification of the anti-exfoliation plates (40) as shown in the FIG. 6, a plurality of holes (40*a*) are radically formed through the antiexfoliation plates (40) to receive and store lubricants such as grease therein.

If a lubricant, e.g., grease is poured and kept in the holes (40*a*), friction caused by the rotation of the rotor (20) and the magnets (30) between the polarity plates (10) can be reduced, and thus the rotor (20) can rotate more smoothly. Consequently, change of directional positions of the rotor (20) to switch on and off magnetization of the lifting machine to lift and release objects can be achieved more smoothly, so that its commercial applicability and credibility can be significantly improved.

Figure 7:
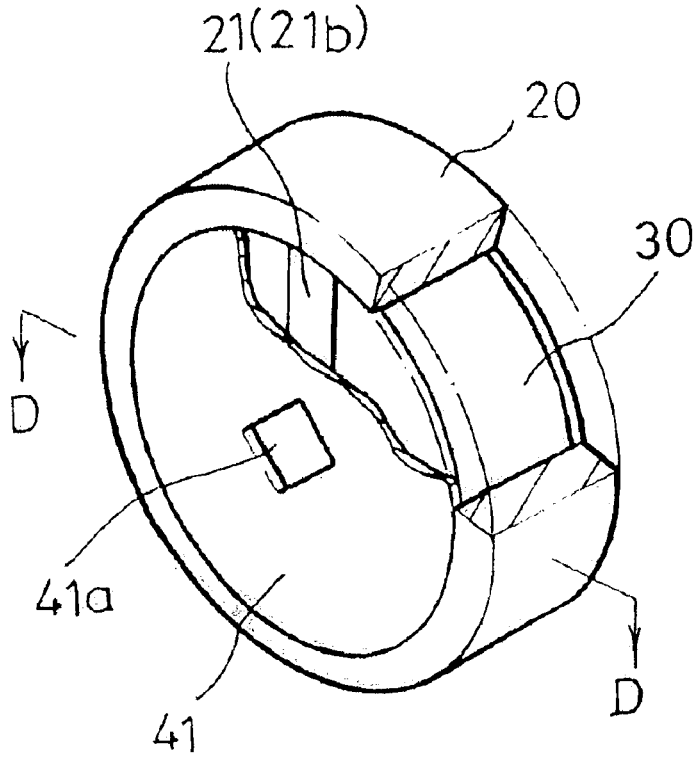
FIG. 7(*a*) is a perspective view partially in section showing a second embodiment of a rotor having neodymium magnets and anti-exfoliation plates therein.
Figure 7:
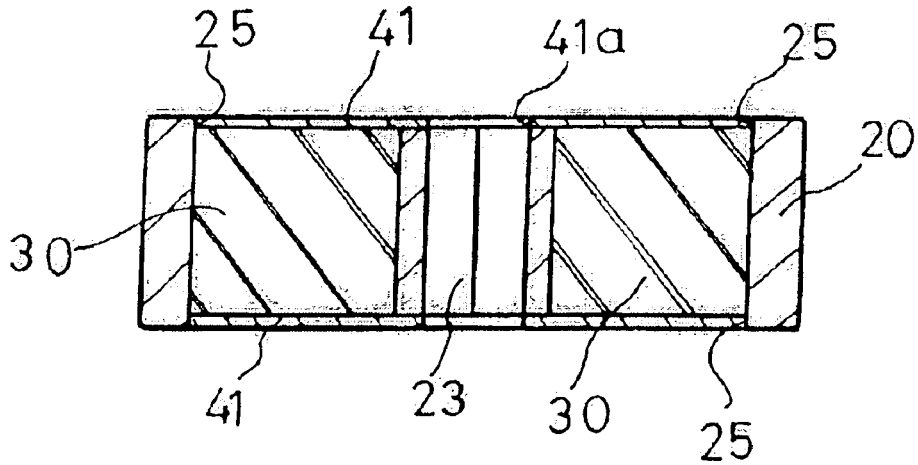

Referring to FIG. 7, a second embodiment of the magnetic lifting machine according to the present invention will be described.

As all the constitutional parts of the magnetic lifting machine in the second and subsequent embodiments are the same as those in the first embodiment with the exception of means for fitting the anti-exfoliation plates into the rotor, reference numerals used in the first embodiment will also be used in the second and subsequent embodiments for identical parts of the machine, and description on the identical parts will be omitted.

In the second embodiment, the rotor (20) is formed in the shape of a cylinder and has the central support (21) integrally formed along the diameter to divide the cylindrical rotor into two receptacles (22). The central support (21) in the second embodiment, however, is inwardly dented on both sides of the rotor (20) by the thickness of anti-exfoliation plates (41), and its thickness is the same as that of the neodymium magnets (30) fitted into the receptacles (22).

The neodymium magnet (30) is in the form of a semicircle, which is substantially the same as the cross-section of the receptacle (22) of the rotor (20), but the thickness of the magnets (30) is slightly less than that of the periphery of the rotor (20).

The anti-exfoliation plates (41) are shaped in the form of a circle having the same diameter as the inside diameter of the rotor (20). Each of the anti-exfoliation plates (41) has a rectangular axis aperture (41*a*) through which the shaft (90) passes.

As shown in FIG. 7, the rotor (20), the neodymium magnets (30) and the anti-exfoliation plates (41) are combined together by inserting a pair of the neodymium magnets (30) into the receptacles (22) of the rotor (20) respectively, and then by fitting the two circular anti-exfoliation plates (41) into the two stepping portions (25) formed on both sides of the neodymium magnets (30) having the same thickness as the central support (21) of the rotor (20). The thickness of the periphery of the rotor (20) is the thickness of the central support (21) plus the thickness of the two anti-exfoliation plates (41).

According to the second embodiment of the magnetic lifting machine constructed as in the above, the effect of protection of the antioxidant film of the neodymium magnets (30) can be obtained. Additionally, release of the anti-exfoliation plates (41) from the rotor (20) can be prevented since the shaft (90) is directly inserted in the rectangular axis apertures (41*a*) in the center of the anti-exfoliation plates (41) to rotate with the rotor (20).

Figure 8:
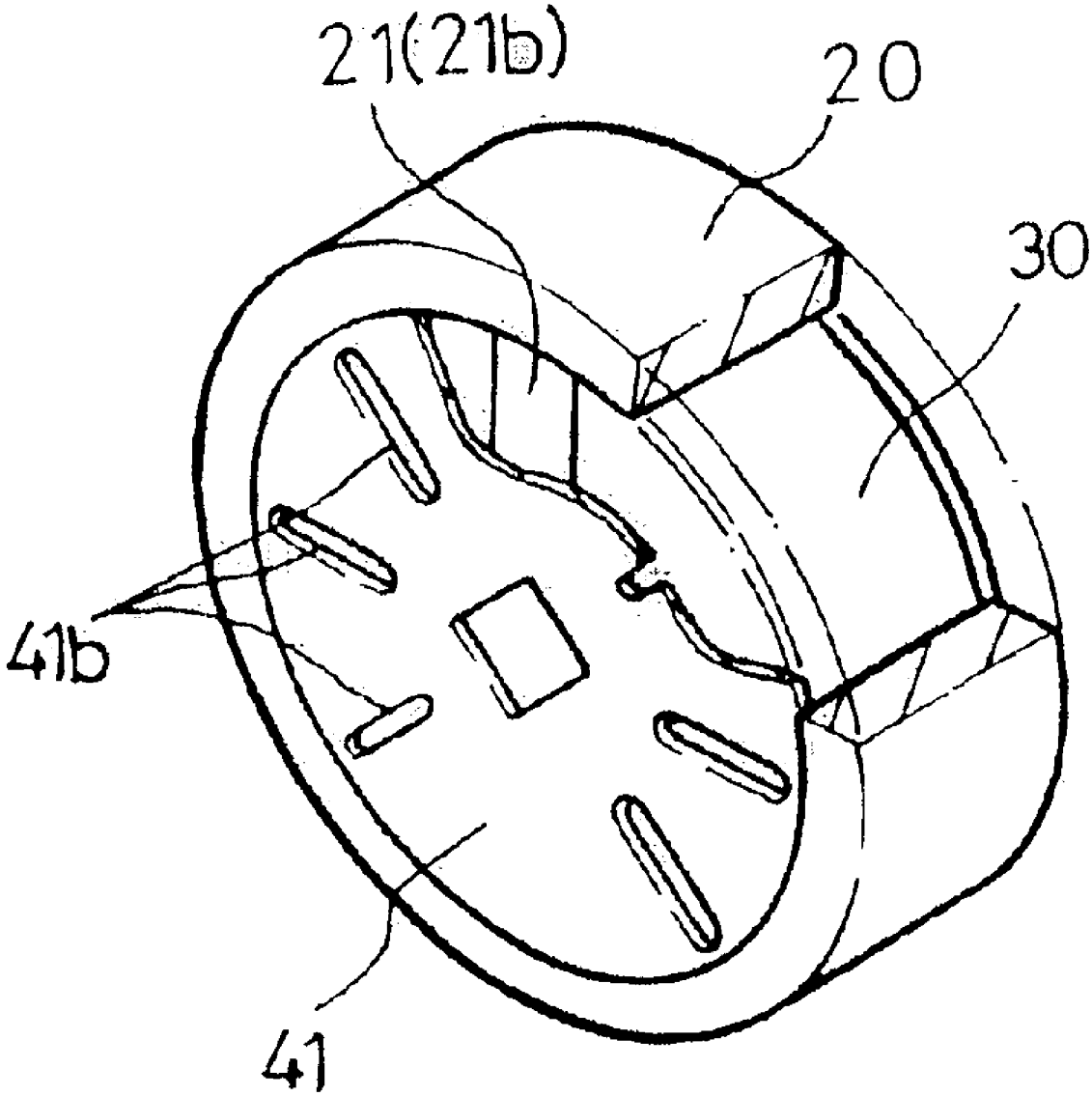
FIG. 8 is a perspective view partially in section showing a modification of the anti-exfoliation plates in FIG. 7.

In the second embodiment, the anti-exfoliation plates (41) are shaped in the form of thin plates. However, in the modification of the anti-exfoliation plates (41) as shown in the FIG. 8, a plurality of holes (41*b*) are radically formed through the antiexfoliation plates (41) to receive and store lubricants such as grease therein, thus producing the same effects as in the first embodiment.

Figure 9:
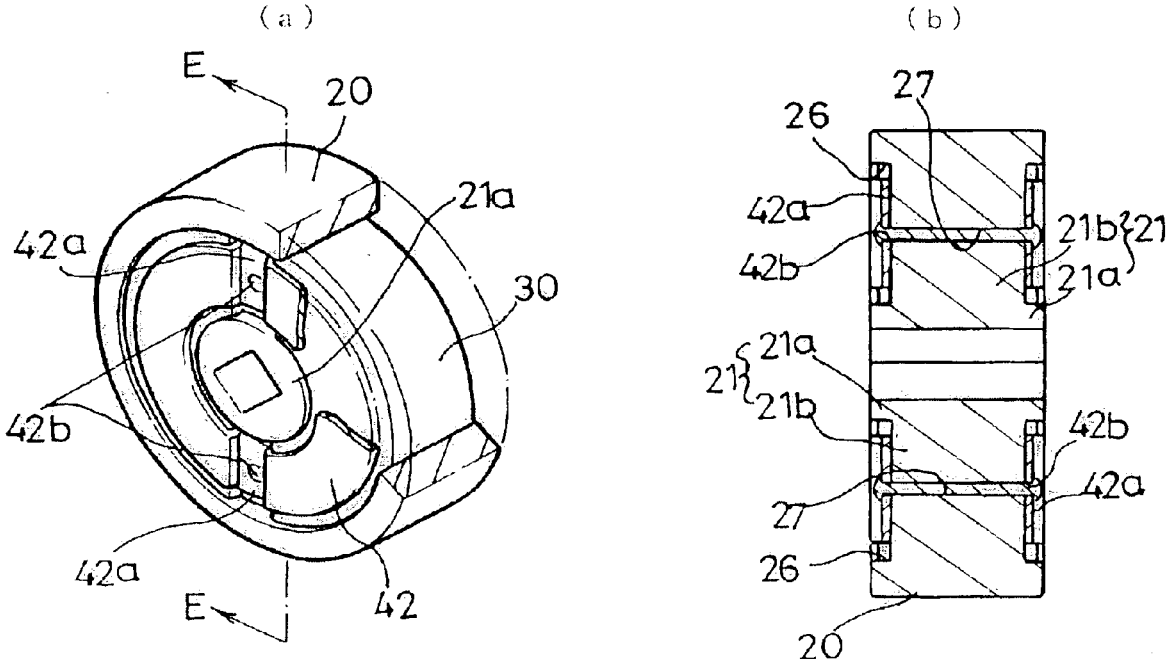
FIG. 9(*a*) is a perspective view partially in section showing a third embodiment of a rotor having neodymium magnets and anti-exfoliation plates therein.

Referring to FIG. 9, a third embodiment of the magnetic lifting machine according to the present invention will be described.

In the third embodiment, anti-exfoliation plate (42) are shaped in the form of a ring having the outside diameter slightly smaller than the inside diameter of the rotor (20) and the inside diameter slightly larger than the outside diameter of the boss (21*a*) of the central support (21). Each of the anti-exfoliation plates (42) has two concaved parts (42*a*) in opposite along the arms (21*b*) of the central support (21) of the rotor (20). In the center of each of the concaved parts (42*a*), a hole for bolt (42*b*) is formed.

The rotor (20) is formed in the shape of a cylinder and has the central support (21) integrally formed along the diameter to divide the cylindrical rotor (20) into two receptacles (22). The central support (21) has the boss (21*a*) in the center having the same thickness as the periphery of the rotor (20) and also has a pair of arms (21*b*), each of which is inwardly dented on both sides by the thickness of the anti-exfoliation plate (42) plus the thickness of the head of a bolt. A hole for bolt (27) is formed in the center of each arm (21*b*).

The neodymium magnet (30) is generally in the form of a semicircle, which is substantially the same as the cross-section of the receptacle (22) of the rotor (20), but the thickness of the magnet (30) is slightly less than that of the rotor (20).

As shown in FIG. 9, the rotor (20), the neodymium magnets (30) and the anti-exfoliation plates (42) are combined together by inserting a pair of the neodymium magnets (30) into the receptacles (22) of the rotor (20) respectively, then by fitting the two anti-exfoliation plates (42) into the two stepping portions (26) which are formed on both sides of the magnets (30) due to the difference in thickness of the rotor (20) and the neodymium magnets (30), and then by fastening the anti-exfoliation plates (42) and the arms (21*b*) of the rotor (20) with bolts through the holes (42*b*).

According to the third embodiment of the magnetic lifting machine constructed as in the above, the effect of protection of the antioxidant film of the neodymium magnets (30) can be obtained. Additionally, release of the anti-exfoliation plates (42) from the rotor (20) can be prevented since the anti-exfoliation plates (42) are coupled with the rotor (20) by bolts.

Figure 10:
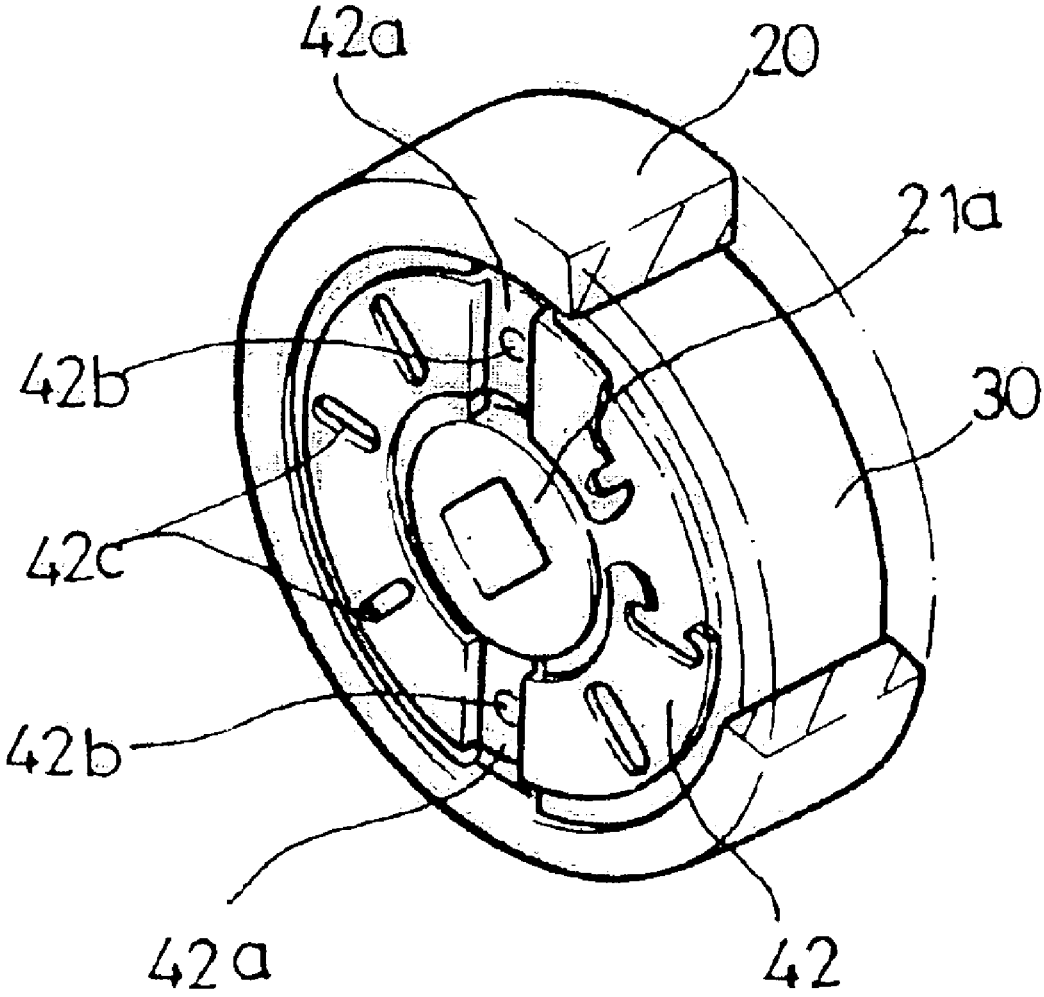
FIG. 10 is a perspective view partially in section showing a modification of the anti-exfoliation plates in FIG. 9.

In the third embodiment, the anti-exfoliation plates (42) are shaped in the form of thin plates. However, in the modification of the anti-exfoliation plates (42) as shown in the FIG. 10, a plurality of holes (42*c*) are radically formed through the anti-exfoliation plates (42) to receive and store lubricants such as grease therein, thus showing the same effects as in the first and second embodiments.

Figure 11:
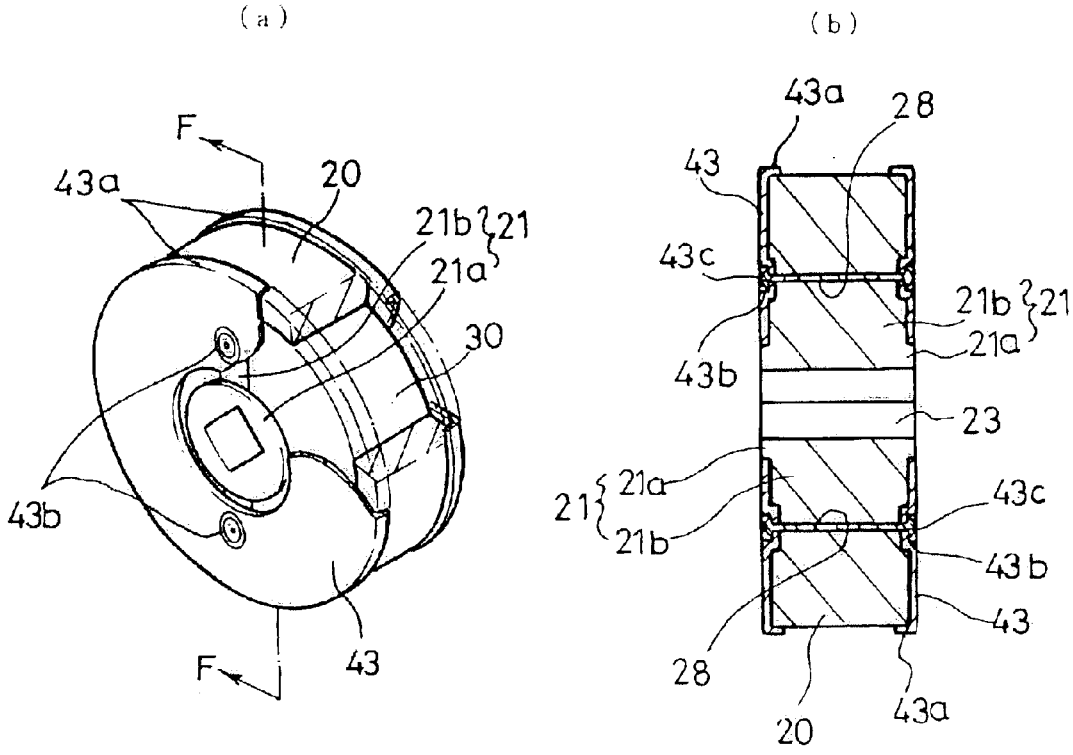
FIG. 11(*a*) is a perspective view partially in section showing a fourth embodiment of a rotor combined with neodymium magnets and anti-exfoliation plates.

Referring to FIG. 11, a fourth embodiment of the magnetic lifting machine will be described.

In the fourth embodiment, anti-exfoliation plates (43) are shaped in the form of a ring having the outside diameter slightly larger than the outside diameter of the rotor (20) and the inside diameter slightly larger than the outside diameter of the boss (21*a*) of the central support (21). Each of the anti-exfoliation plates (41) has an extended flange (43*a*) along its periphery and two concaved parts (43*b*) in opposite along the arms (21*b*) of the central support (21) of the rotor (20). In the center of each of the concaved parts (43*b*), a hole for bolt (43*c*) is formed.

The rotor (20) is formed in the shape of a cylinder and has the central support (21) integrally formed along the diameter to divide the cylindrical rotor (20) into two receptacles (22). The central support (21) has the boss (21*a*) in the center having the thickness slightly larger than that of the periphery of the rotor (20) and also has a pair of arms (21*b*), each of which is dented in the center on both sides to receive the concaved parts (43*b*) of the anti-exfoliation plates (43). A hole for bolt (28) is formed in the center of each arm (21*b*).

The neodymium magnet (30) is generally in the form of a semicircle, which is substantially the same as the cross-section of the receptacle (22) of the rotor (20), and the thickness of the magnet (30) is the same as that of the rotor (20).

As shown in FIG. 11, the rotor (20), the neodymium magnets (30) and the anti-exfoliation plates (43) are combined together by inserting a pair of the neodymium magnets (30) into the receptacles (22) of the rotor (20) respectively, then by fitting the two anti-exfoliation plates (43) onto both sides of the rotor (20), and then by fastening the anti-exfoliation plates (43) and the arms (21*b*) of the rotor (20) with bolts through the holes (43*c*).

According to the fourth embodiment of the magnetic lifting machine constructed as in the above, the effect of protection of the antioxidant film of the neodymium magnets (30) can be obtained. Additionally, release of the anti-exfoliation plates (43) from the rotor (20) can be prevented since the anti-exfoliation plates (43) are coupled with the rotor (20) by bolts.

Figure 12:
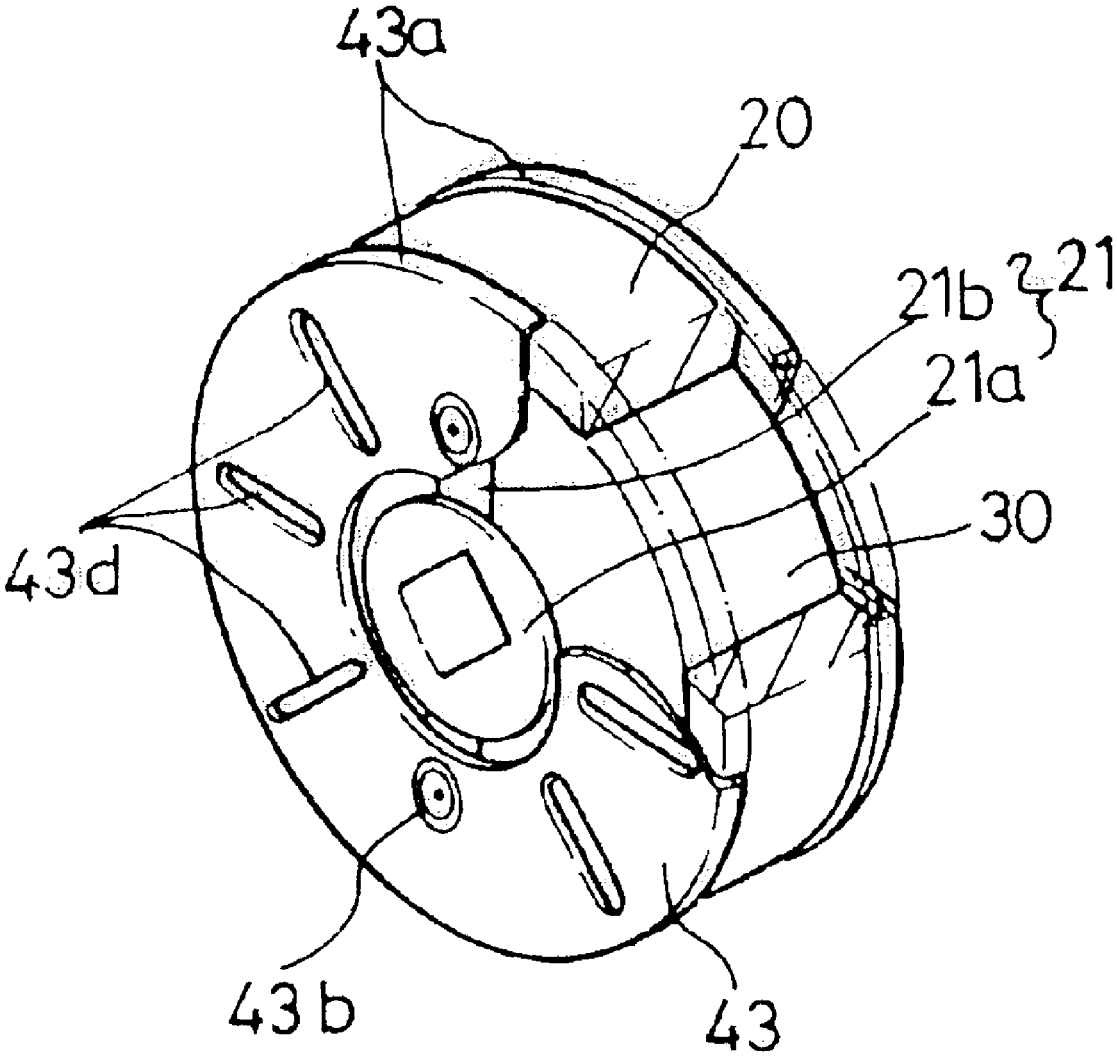
FIG. 12 is a perspective view partially in section showing a modification of the anti-exfoliation plates in FIG. 11.

In the fourth embodiment, the anti-exfoliation plates (43) are shaped in the form of thin plates. However, in the modification of the anti-exfoliation plates (43) as shown in the FIG. 12, a plurality of holes (43*d*) are radically formed through the anti-exfoliation plates (43) to receive and store lubricants such as grease therein, thus showing the same effects as in the first to third embodiments.

As described above, the magnetic lifting machine according to the present invention can prevent the antioxidant film on the surface of neodymium magnets from exfoliation, since the neodymium magnets are not in direct contact with the polarity plates but via the anti-exfoliation plates.

Further, the magnetic lifting machine according to the present invention, change of directional positions of the rotor for switching on and off magnetization can be done smoothly, and thus the credibility and commercial applicability can be enhanced.

Furthermore, the magnetic lifting machine according to the present invention has simple structure of preventing the exfoliation of the antioxidant film of the neodymium magnets, and thus can be manufactured with lower costs and with smaller volume than conventional magnetic lifting machines.

It will be apparent to those skilled in the art that various modifications and variations can be made to the present invention without departing from the spirit and scope of the invention. The present invention covers the modifications and variations provided they come within the scope of the appended claims and their equivalents.

What is claimed is:

1. A magnetic lifting machine comprising:

a pair of polarity plates (10) disposed to be opposite each other to form side walls of the machine and having a non-magnetic medium (11) in the longitudinal center thereof and magnetic members (12) on both sides of the non-magnetic medium (11);

a cylindrical rotor (20) axially supported to be rotatable between the polarity plates (10);

a pair of neodymium magnets (30) inserted in the rotor (20) and having N/S magnetic poles opposite to each other;

a pair of fixed magnets (50) in the vicinity of the rotor (20);

a shaft (90) supporting the rotor (20); and thin anti-exfoliation plates (40, 41, 42 or 43) made of non-magnetic material and fitted to both sides of the rotor (20) to prevent the neodymium magnets (30) coated with antioxidant film from being exfoliated.

2. The magnetic lifting machine as claimed in claim 1, wherein each of the anti-exfoliation plates (40, 41, 42 or 43) includes a plurality of holes (40*a*, 41*b*, 42*c* or 43*d*) for oil storage radially formed therethrough.

* * * * *